US006978861B2

(12) United States Patent
Yu

(10) Patent No.: US 6,978,861 B2
(45) Date of Patent: Dec. 27, 2005

(54) CONNECTION OF SOUND BOWL OF LOUDSPEAKER

(76) Inventor: A Wen Yu, 235 Chung-Ho Box 8-24, Taipei (TW)

( * ) Notice: Subject to any disclaimer, the term of this patent is extended or adjusted under 35 U.S.C. 154(b) by 184 days.

(21) Appl. No.: 10/179,260

(22) Filed: Jun. 26, 2002

(65) Prior Publication Data

US 2004/0000447 A1 Jan. 1, 2004

(51) Int. Cl.[7] ..... G10K 13/00

(52) U.S. Cl. ..... 181/172; 181/171

(58) Field of Search ..... 181/157, 160–174

(56) References Cited

U.S. PATENT DOCUMENTS 6,378,649 B1 * 4/2002 Inoue et al. ..... 181/167
6,390,232 B1 * 5/2002 Kirschbaum ..... 181/169

* cited by examiner

*Primary Examiner*—Kimberly Lockett

(57) ABSTRACT

A connection of the sound bowl and connecting portion of a loudspeaker is disclosed. The connection area is adhered with the elastic materials similar to the materials of sound bowl and connecting portion in order to beautify the appearance of loudspeaker and enhance the adhesion. Thereby the tolerance of the loudspeaker is enhanced. Thus, the loudspeaker is tolerable to vibration and produces sound with precise tunes, and stabilizes the quality of sound.

8 Claims, 5 Drawing Sheets

CONNECTION OF SOUND BOWL OF LOUDSPEAKER

BACKGROUND OF THE INVENTION

1. Field of the Invention

The present invention relates to loudspeakers, and particularly to a sound bowl structure of a loudspeaker, wherein a sound bowl is connected to a connecting portion of loudspeaker, thereby, simplifying the manufacturing process procedure and enhancing the sound effect of loudspeaker.

2. Description of the Prior Art

Generally, a loudspeaker consists of a pressing bar 3, a connecting portion 2, a sound bowl 1, a sound coil, a suspension system, and a magnet. As required, most of the loudspeakers are manufactured in such a manner that the sound bowl 1 is adhered to the surface of connecting portion 2 as shown by FIG. 1.

How the loudspeaker emits sound will be described herein. At first, electric signals is sent into a sound coil to create a magnetic field. The magnetic field of the magnet can be absorbed through vibration. Then the vibration applies presses to the sound bowl 1 and transmits expected voices through air. The vibration created by the sound bowl 1 produces voice. The sound bowl 1 also handles the volume and tunes. Therefore, the structure connecting the sound bowl 1 and connecting portion 2 determines the quality of sound and affects the life of the loudspeaker.

As shown in FIG. 1, the sound bowl 1 of the conventional loudspeaker is adhered to the connecting portion 2 by using glue. Hence, the manufacturing cost is high. The adhesion layer is possibly uneven and inaccurate. These problems affect the quality of sound and possibly damage the loudspeaker.

SUMMARY OF THE INVENTION

The present invention relates to the connection of the sound bowl and connecting portion of a loudspeaker. The connection area is adhered with the elastic materials similar to the materials of sound bowl and connecting portion in order to beautify the appearance of loudspeaker and enhance the adhesion. Thereby the tolerance of the loudspeaker is enhanced. Thus, the loudspeaker is tolerable to vibration and produces sound with precise tunes, and stabilizes the quality of sound.

DETAILED DESCRIPTION OF THE PREFERRED EMBODIMENT

Figure 1:
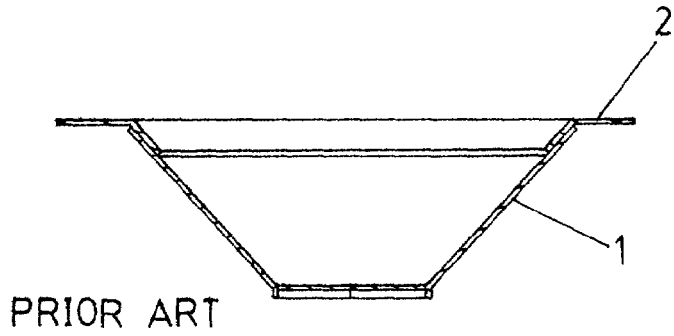
FIG. 1 is a sectional view showing the structure of a conventional loudspeaker.
Figure 2:
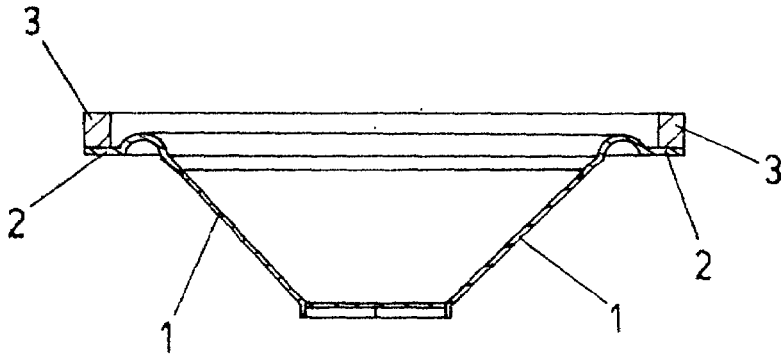
FIG. 2 is a schematic view showing the structure of the loudspeaker of the present invention.

As shown in FIG. 2, the present invention mainly comprises a sound bowl 1, a connecting portion 2, and a pressing bar 3.

Figure 3:
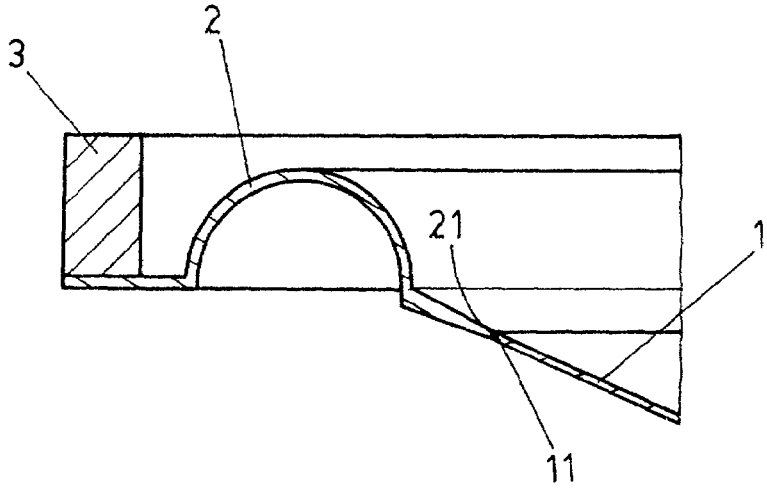
FIG. 3 is a structural view showing a portion of the loudspeaker of the present invention.

The sound bowl 1 is a bowl-shaped device with a flat connection rim 11 connecting to the connecting portion 2. The connecting portion 2 is a slightly arc-shaped elastic structure serving as a buffer. The inner rim thereof is also a flat connection rim 21 as shown by FIG. 3.

The sound bowl 1 and connecting portion 2 can be made of hard plastic materials, such as PP and PS. Both flat connection rims 11, 21 are connected with thermal-plastic elastomers and are kept at a temperature of about 100~140° C.; and thermal-plastic material are injected into a mold to connect both flat connection rims 11, 21 under proper temperatures (such as 160~210° C.) as one piece.

The foregoing manufacturing process ensures the firm connection between the sound bowl 1 and connecting portion 2, and is capable of tolerating the effects of different levels of volumes and tunes, thereby making the sound perfect and attractive.

Figure 4:
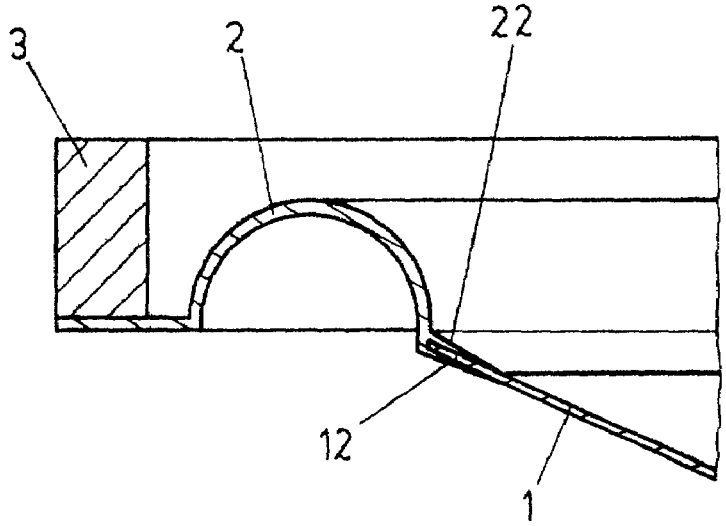
FIG. 4 is a schematic view showing the loudspeaker in one embodiment of present invention.

As shown by FIG. 4, the manufacturers can also use the plug-in connection ends 12, 22 to connect the sound bowl 1 and connecting portion 2; thereby enlarging the contact area and enhances the reliability of connection by the double-sided wrapping structure.

Figure 5:
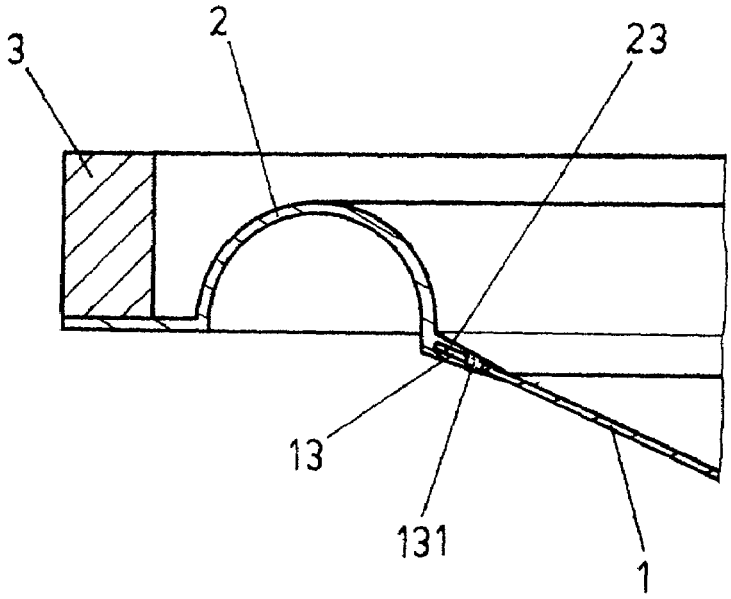
FIG. 5 is another schematic view showing the loudspeaker in one embodiment of present invention.

As shown by FIG. 5, in another embodiment of the present invention, punching-holed connection ends 13, 23 are used for the connection in the present invention. The design of present invention allows the thermal-plastic elastomers to be filled into the punching hole 131. Thereby enhancing the connection.

Figure 6:
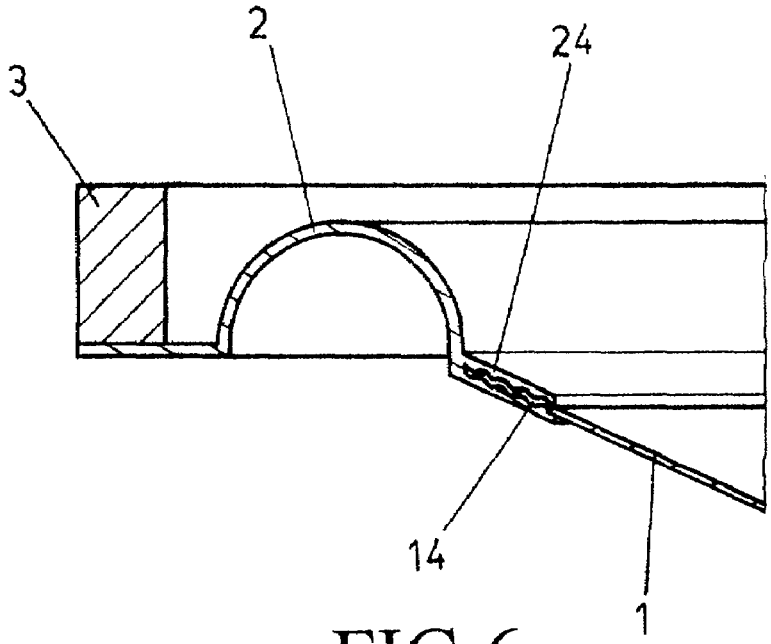
FIG. 6 is another schematic view showing the loudspeaker in one embodiment of present invention.
Figure 7:
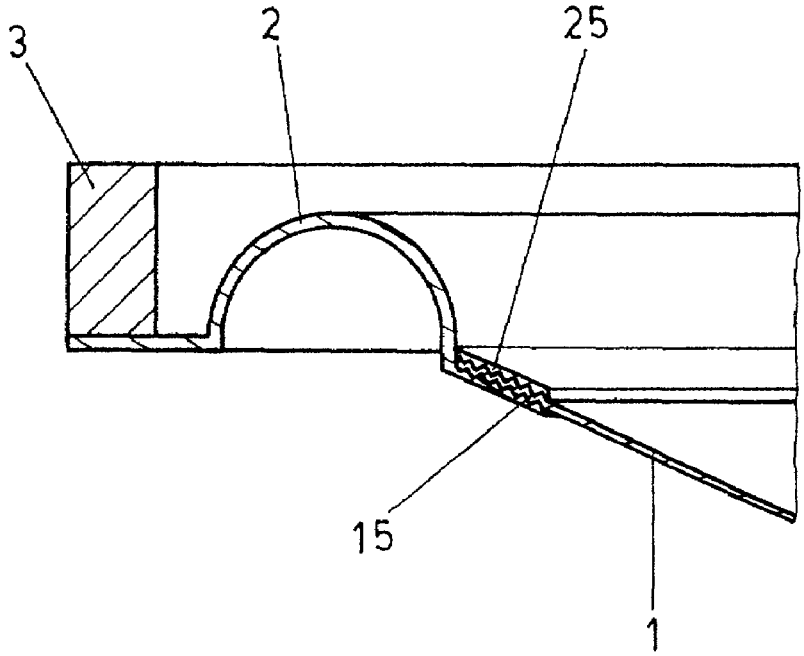
FIG. 7 is another schematic view showing the loudspeaker in one embodiment of present invention.

As shown by FIG. 6 and FIG. 7, in a further embodiment, the connection of present invention can be made by the arc connection ends 14, 24 or the right-angled connection ends 15, 25.

Figure 8:
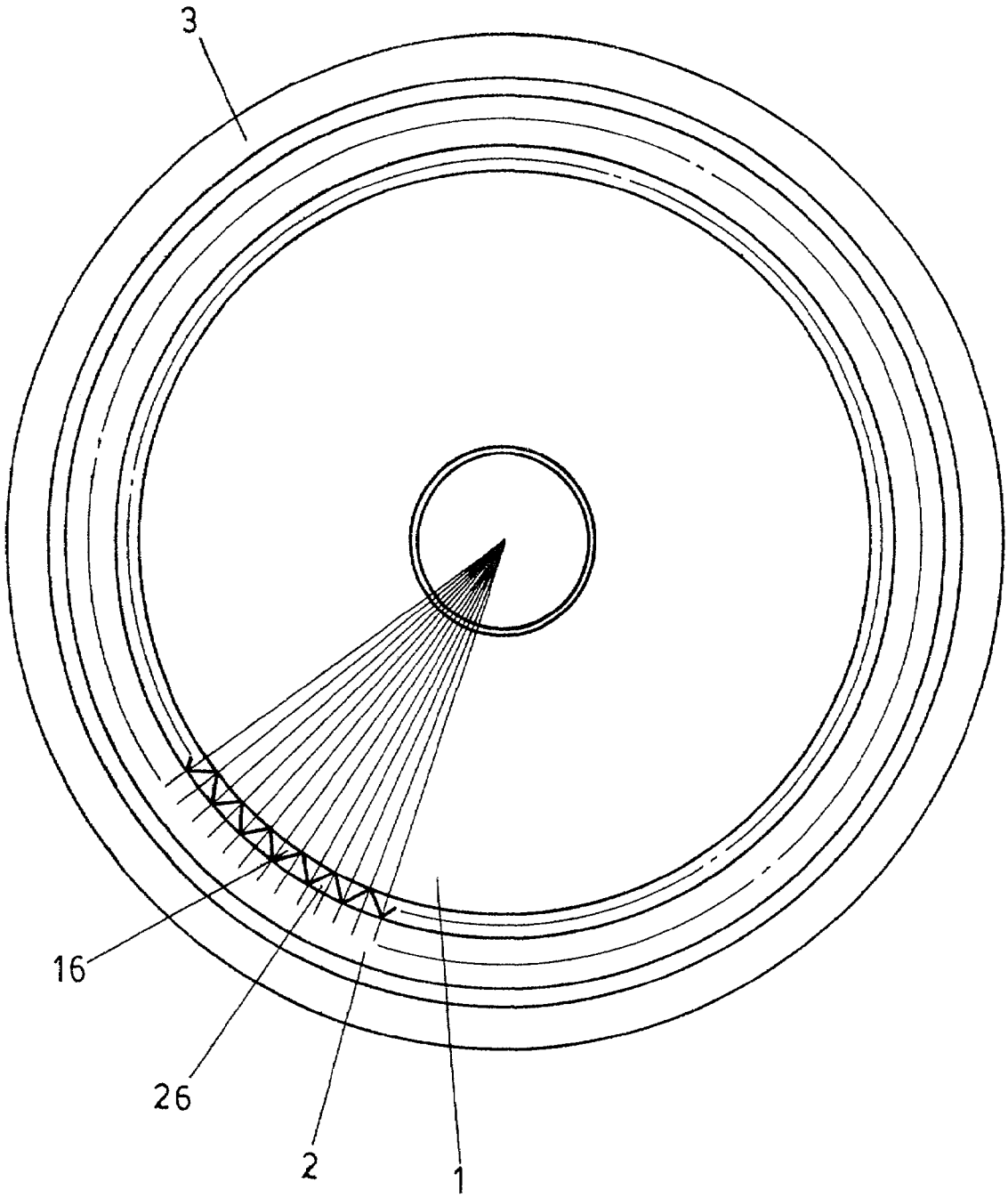
FIG. 8 is another structural view showing the loudspeaker in one embodiment of present invention.
Figure 9:
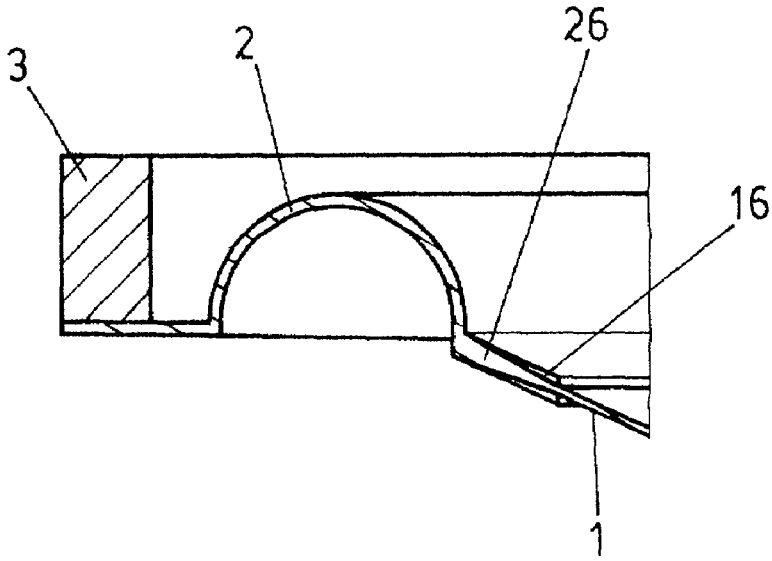
FIG. 9 is a structural view showing a portion of the loudspeaker in one embodiment of present invention.
Figure 10:
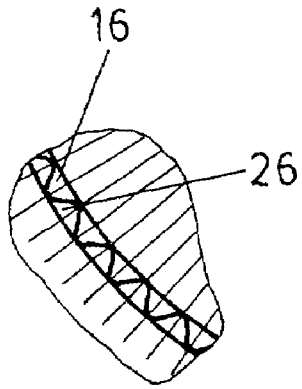
FIG. 10 is a structural view showing a portion of the loudspeaker in one embodiment of present invention.
Figure 11:
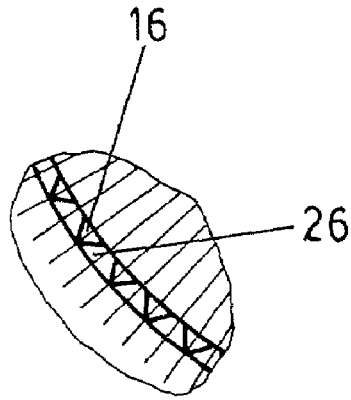
FIG. 11 is a structural view showing a portion of the loudspeaker in one embodiment of present invention.

The connection surface of the trumpet of present invention can be folded shown in FIG. 8 and FIG. 9. The folded structure or circumferences 16, 26 can be either sharp angles or the shape shown in FIG. 10. The round-angled structure and flat-angled structure stated in FIG. 11 can enhance the tolerance of connection.

By the above state structure, the present invention is capable of upgrading the performance of loudspeaker and improving the quality of sound in order to solve the problems of the conventional loudspeaker.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A loudspeaker comprising a bowl-shaped sound bowl having a plurality of connecting sides which are punched with holes;

an arc-shaped elastic connecting portion punched with holes; and a plurality of thermal-plastic elastomer; the connecting sides of the bowl-shaped sound bowl and the arc-shaped elastic connecting portion being connected by filling the thermal-plastic elastomers into the holes of the bowl-shaped sound bowl and holes of the arc-shaped elastic connecting portion;

wherein in manufacturing, thermal-plastic elastomer is injected into a mold to connect the connecting portion and the sound bowl at a predetermined temperature; the connecting sides of the bowl-shaped sound bowl and the arc-shaped connection portion are punched with the holes; and the thermal plastic material is filled into the holes.

2. The loudspeaker as claimed in claim 1, wherein the bowl-shaped sound bowl and arc-shaped elastic connecting portion are made of hard plastic materials.

3. The loudspeaker as claimed in claim 1, wherein the bowl-shaped connecting sides of the sound bowl and arc-shaped elastic connecting portion are flat.

4. The loudspeaker as claimed in claim 1, wherein the bowl-shaped connecting side of the sound bowl is engaged with the arc-shaped elastic connecting portion.

5. A loudspeaker comprising a bowl-shaped sound bowl having a plurality of connecting sides which are folded as a plurality of folds along peripheries of the edges of the bowl-shaped sound bowl;

an arc-shaped elastic connecting portion which are folded as a plurality of folds along peripheries of the edges of the arc-shaped sound bowl; and a plurality of thermal-plastic elastomer; the connecting sides of the bowl-shaped sound bowl and the arc-shaped elastic connecting portion being connected by the thermal-plastic elastomers;

wherein manufacturing, thermal-plastic elastomer is injected into a mold to connect the connecting portion and the sound bowl at a predetermined temperature; the connecting sides of the sound bowl and the connecting portion are folded as a plurality of folds along the peripherys of the edges of the sound bowl ad the connecting portion.

6. The loudspeaker as claimed in claim 5, wherein the bowl-shaped sound bowl and are-shaped elastic connecting portion are made of hard plastic materials.

7. The loudspeaker as claimed in claim 5, wherein the connecting sides of the bowl-shaped sound bowl and arc-shaped elastic connecting portion are flat.

8. The loudspeaker as claimed in claim 5, wherein the connecting side of the bowl-shaped sound bowl is engaged with the arc-shaped elastic connecting portion.

* * * * *